US007293806B2

(12) United States Patent
Umino

(10) Patent No.: US 7,293,806 B2
(45) Date of Patent: Nov. 13, 2007

(54) SELECTIVE ONE-MOTION DOOR OPENING MECHANISM FOR DOOR LATCH OF VEHICLE

(75) Inventor: Masahiko Umino, Yamanashi-ken (JP)

(73) Assignee: Mitsui Kizoku Kogy Kabushiki Kaisha, Tokyo (JP)

( * ) Notice: Subject to any disclaimer, the term of this patent is extended or adjusted under 35 U.S.C. 154(b) by 239 days.

(21) Appl. No.: 10/486,266

(22) PCT Filed: Aug. 7, 2002

(86) PCT No.: PCT/JP02/08066

§ 371 (c)(1),
(2), (4) Date: Dec. 20, 2004

(87) PCT Pub. No.: WO03/014499

PCT Pub. Date: Feb. 20, 2003

(65) Prior Publication Data

US 2005/0087994 A1 Apr. 28, 2005

(30) Foreign Application Priority Data

Aug. 7, 2001 (JP) ..... 2001-238925
Aug. 9, 2001 (JP) ..... 2001-242095

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/201, 292/216, DIG. 23

See application file for complete search history.

(56) References Cited

U.S. PATENT DOCUMENTS

| | | | | |
|---|---|---|---|---|
| 5,531,488 | A * | 7/1996 | Yoshikuwa et al. | 292/216 |
| 5,709,420 | A * | 1/1998 | Umino | 292/216 |
| 5,813,709 | A * | 9/1998 | Umino | 292/216 |
| 5,961,164 | A * | 10/1999 | Gomi | 292/216 |
| 6,059,328 | A * | 5/2000 | Gomi | 292/216 |
| 6,371,538 | B1 * | 4/2002 | Inoue | 292/216 |
| 6,607,222 | B2 * | 8/2003 | Inoue | 292/216 |
| 7,080,861 | B2 * | 7/2006 | Watanabe | 292/216 |

FOREIGN PATENT DOCUMENTS

| | | |
|---|---|---|
| JP | 54-65122 | 5/1979 |
| JP | 4-20683 A | 1/1992 |
| JP | 2000-345754 A | 12/2000 |

* cited by examiner

*Primary Examiner*—Carlos Lugo
(74) *Attorney, Agent, or Firm*—Browdy and Neimark, PLLC

(57) ABSTRACT

The present selective type one-motion door opening mechanism comprises a ratchet lever (32) for opening a vehicle door, an open lever (22) displaceable by an outside open handle (25), a lock lever (23) displaceable between an unlocked position (U) in which a displacement of the open lever is transmitted to the ratchet lever and an locked position (L) in which the displacement of the open lever is not transmitted to the ratchet lever, a sub-lever (35) being rotated by an inside open handle (19), and a selector pin (41) displaceable between an effective position (X) and to a ineffective position (Y). The rotation of the ratchet lever returns the lock lever to the unlocked position. The selector pin at the effective position transmits the rotation of the sub-lever to the ratchet lever, and selector pin at the ineffective position transmits the rotation of the sub-lever to the open lever.

7 Claims, 7 Drawing Sheets

SELECTIVE ONE-MOTION DOOR OPENING MECHANISM FOR DOOR LATCH OF VEHICLE

TECHNICAL FIELD

The present invention relates to a vehicle door latch device, and more particularly, it relates to a one-motion door opening mechanism for a vehicle door latch device.

BACKGROUND ART

In general, in the prevailing vehicle door latch device used hitherto, when a lock mechanism is in a locked state, a door is not opened by a door opening operation of an open handle. However, in the door latch device added with the one-motion door opening mechanism, even when the lock mechanism is in the locked state, a return to an unlocked state of the lock mechanism and an opening of the door are almost simultaneously performed by the door opening operation of an inside open handle.

The one-motion mechanism is a very convenient mechanism. However, since the one-motion mechanism makes it possible to release the locked state and open the door by the operation of the inside open handle, it is generally adopted only to the door latch device of the driver's door.

The one-motion mechanism is a mechanism closely related to another mechanism of the door latch device, and is designed with another mechanism at the same time. Hence, it has been practically impossible to add the one-motion door opening mechanism to the door latch device having no one-motion mechanisms at a later time.

Because of the described reason above, heretofore, the door for other than the driver's seat has been unable to enjoy the convenience of the one-motion door opening mechanism.

BRIEF SUMMARY OF THE INVENTION

Therefore, it is an object of the present invention to provide a one-motion door opening mechanism which can be switched over to an effective state and an ineffective state. A door latch device comprising such a one-motion door opening mechanism can be adopted to all the doors, and if safety is ensured at the user's responsibility, almost all people can enjoy the convenience of the one-motion door opening mechanism.

Moreover, it is another object of the present invention to provide a clutch mechanism, which can invalidate the one-motion door opening mechanism while running. A serious accident due to misuse of the one-motion door opening mechanism can be prevented substantially by the employment of this clutch mechanism.

BEST MODE FOR CARRYING OUT THE INVENTION

Figure 1:
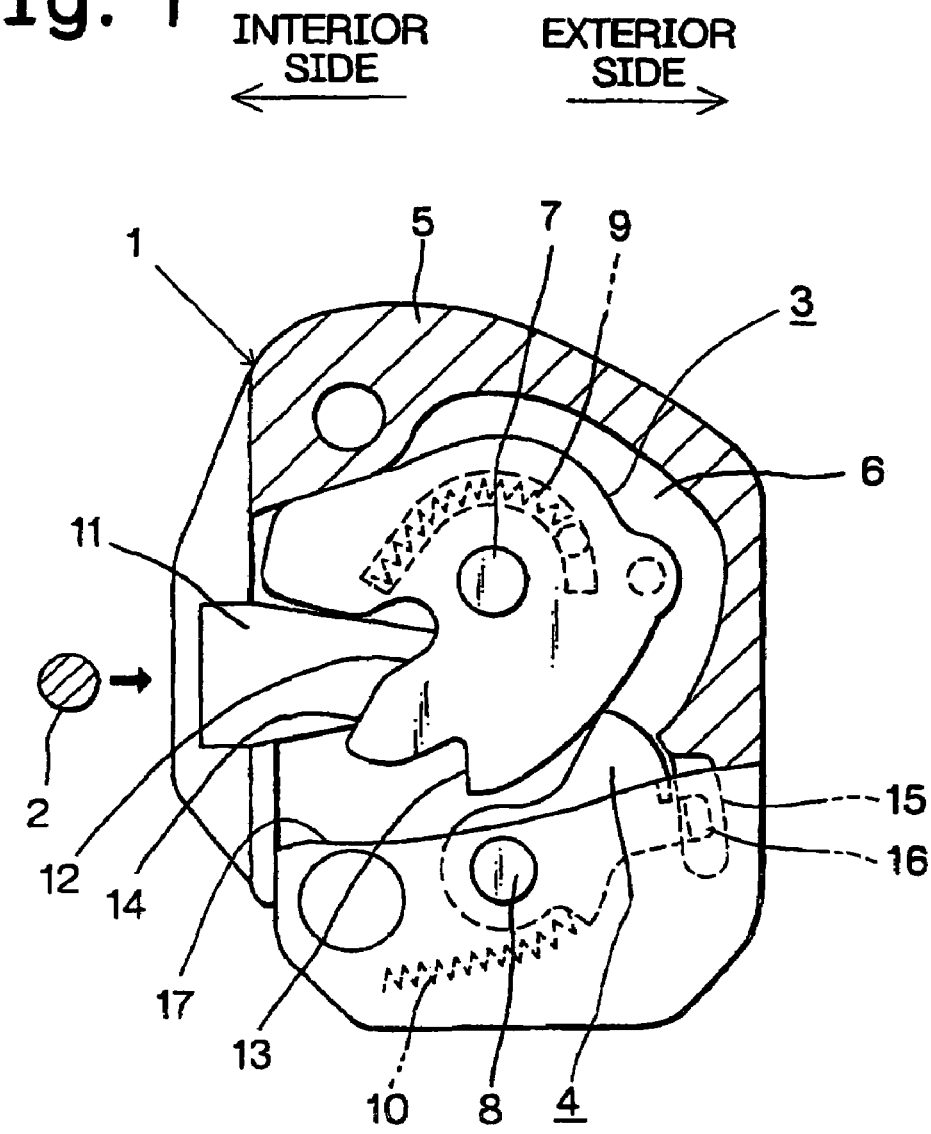
FIG. 1 is a front view of a latch unit according to the present invention.

One embodiment of a vehicle door latch device according to the present invention will be described based on the drawings. The door latch device comprises a latch unit 1 mounted on a door (not shown) and a striker 2 fixed to a vehicle body (not shown). The latch unit 1 comprises a latch 3 which engages with the striker 2 when the door is closed, and a ratchet 4 which maintains the engagement between the latch 3 and the striker 2. The latch 3 is rotatably supported by a latch shaft 7 within a concave portion 6 formed on the surface of a latch body 5 made of synthetic resin, and the ratchet 4 is rotatably supported by a ratchet shaft 8 within the concave portion 6.

The latch 3 is urged in a clockwise direction by the elastic force of a spring 9 in FIG. 1, and the ratchet 4 is urged in a counterclockwise direction by the elastic force of a ratchet spring 10. The latch 3 of FIG. 1 is returned to an unlatched position (door-open position) by the elastic force of the latch spring 9. When the door is moved toward a door-closed position, the striker 2 advances into a horizontal passage 11 formed on the latch body 5 and abuts against a U-shaped groove 12 of the latch 3 to rotate the latch 3 counterclockwise. When the latch 3 is rotated up to a half-latched position, the ratchet 4 is engaged with a first step 13 of the latch 3 and the door reaches a half-closed position, and when the latch 3 comes to a full-latched position, the ratchet 4 is engaged with a second step 14 of the latch 3 and the door is maintained at a full-closed position.

The ratchet 4 comprises a ratchet pin 16 which projects to the rear side of the latch body 5 through an opening 15 of the latch body 5. To the front surface of the latch body 5, a metal cover plate 17 for practically covering the recess 6 is fixed. The cover plate 17 is shown partially in FIG. 1.

Figure 2:
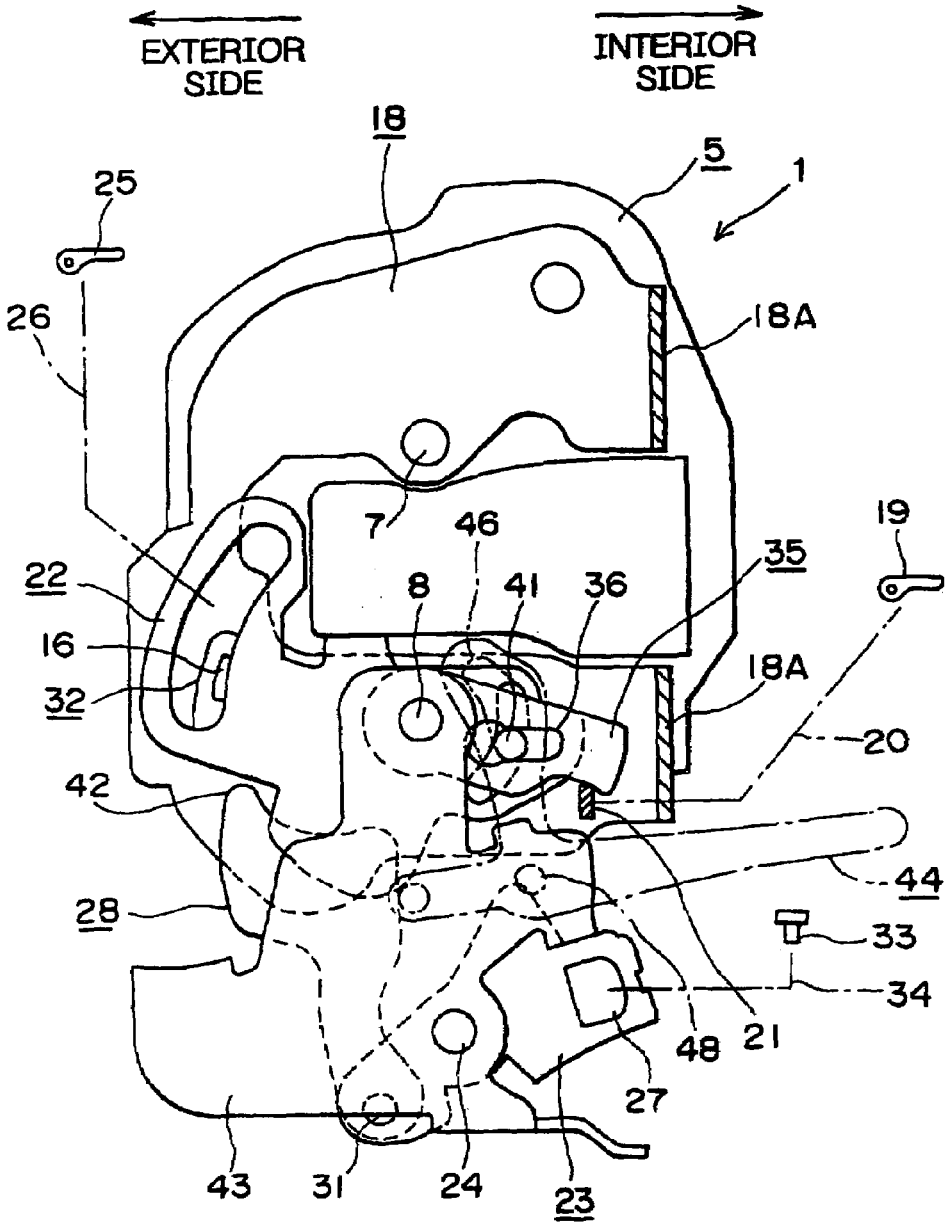
FIG. 2 is a rear view of the latch unit.
Figure 3:
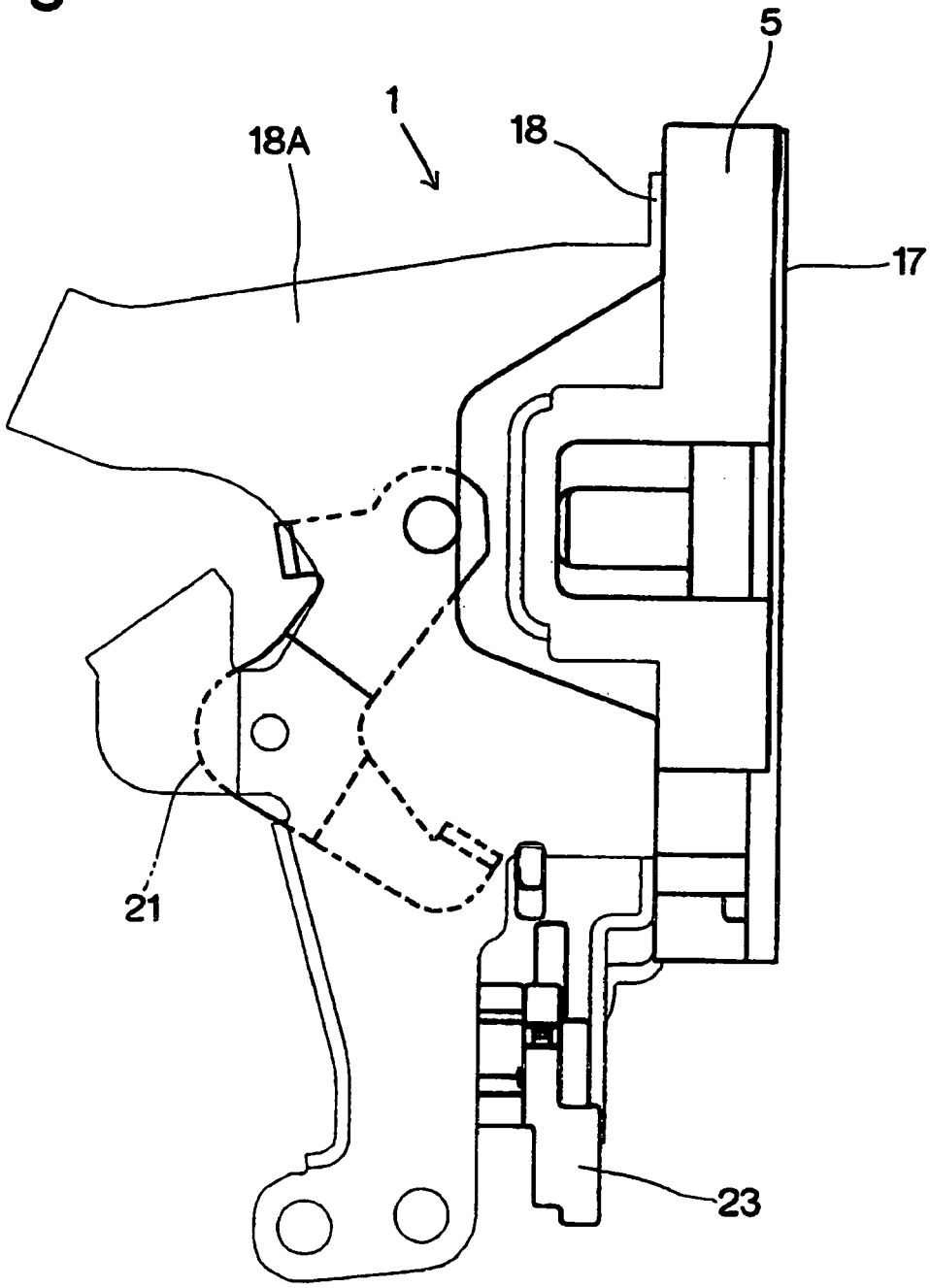
FIG. 3 is a side view of the latch unit.

A metal back plate 18 shown in FIG. 2 is fixed on a rear surface of the latch body 5. The back plate 18 is provided integrally with a bent plate 18A which is angled to extend backward from the interior side of the side. An inner lever 21 is pivotally provided on the bent plate 18A, as shown in FIG. 3, and the inner lever 21 is connected to the inside open handle 19 (FIG. 2) of the door through a wire or a rod 20 and the like.

The latch unit 1 comprises an open lever 22 (FIG. 4) which allows the door to open by disengaging the ratchet 4 from the latch 3, and a lock lever 23 (FIG. 5) which switches the latch unit 1 to a locked state and an unlocked state. The open lever 22 is rotatably mounted on the rear side of the latch body 5 by the ratchet shaft 8. The exterior side portion of the open lever 22 is connected to one end of a rod 26 connected to the outside open handle 25 of the door with a lost-motion. The lock lever 23 is rotatably mounted on the latch body 5 or the back plate 18 by the lock shaft 24. A connection hole 27 is formed on the interior side portion of the lock lever 23.

Figure 6:
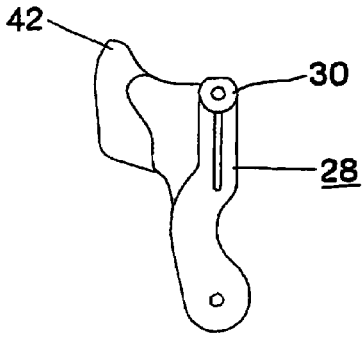
FIG. 6 is a rear view of a lock link of the latch unit.

Between the lock lever 23 and the open lever 22, a lock link 28 (FIG. 6) is provided. The lock link 28 comprises a lock pin 30 which is slidably engaged with a slot 29 formed on the open lever 22. The lower end of the lock link 28 is connected to the lock lever 23 by a shaft 31.

Figure 7:
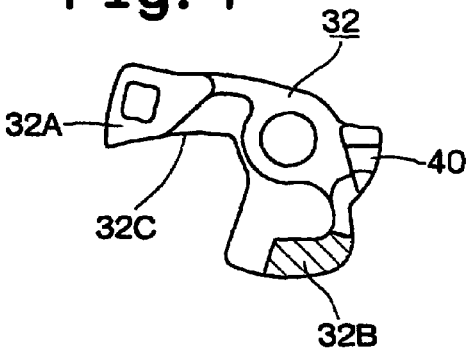
FIG. 7 is a rear view of a ratchet lever of the latch unit.

A ratchet lever 32 (FIG. 7) is pivotally mounted on the ratchet shaft 8. The ratchet lever 32 is located between the latch body 5 and the open lever 22. An outer arm 32A of the ratchet lever 32 extending to the exterior side is engaged with the ratchet pin 16 which extends backward from the ratchet 4, and this allows the ratchet lever 32 to integrally rotate with the ratchet 4.

Figure 10:
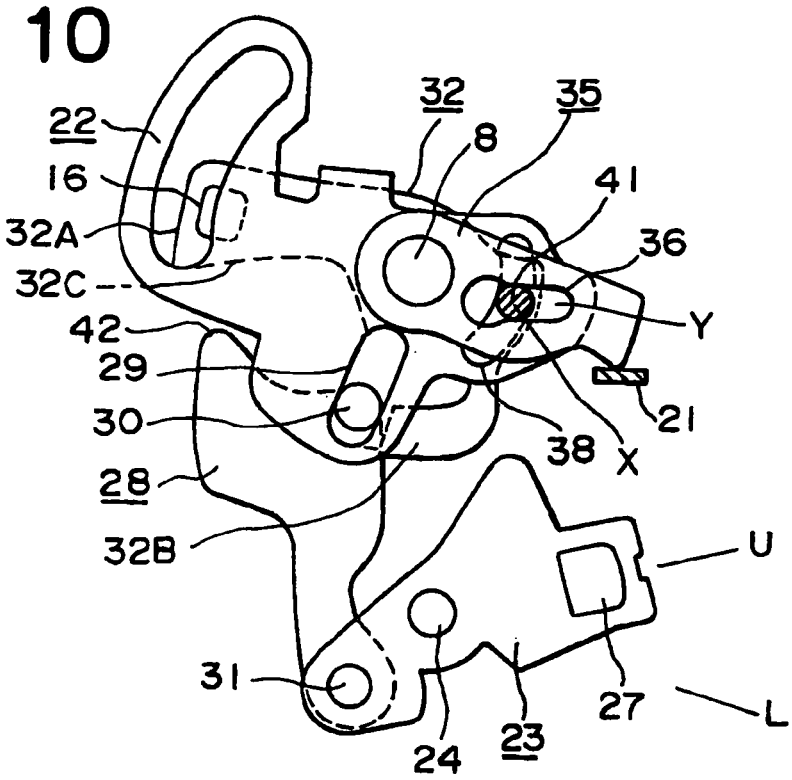
FIG. 10 is an explanatory view showing a state in which the lock lever is in an unlocked position and a one-motion door opening mechanism is in an effective state.

The connection hole 27 of the lock lever 23 is connected to a rod 34 reaching an inside lock button 33 of the door, and the lock lever 23 is switched over, as is known, to an unlocked position U (FIG. 10) and a locked position L (FIG. 11) by the operation of the inside lock button 33. When the lock lever 23 is in the unlocked position U as shown in FIG. 10, the lock pin 30 engageably confronts an inverted L-shaped abutting arm 32B of the ratchet lever 32. When the open lever 22 is rotated counterclockwise in the unlocked state by the operation of the open handle 25, the lock pin 30 abuts against the abutting arm 32B to rotate the ratchet lever 32 counterclockwise, and this allows the door to be opened.

Figure 11:
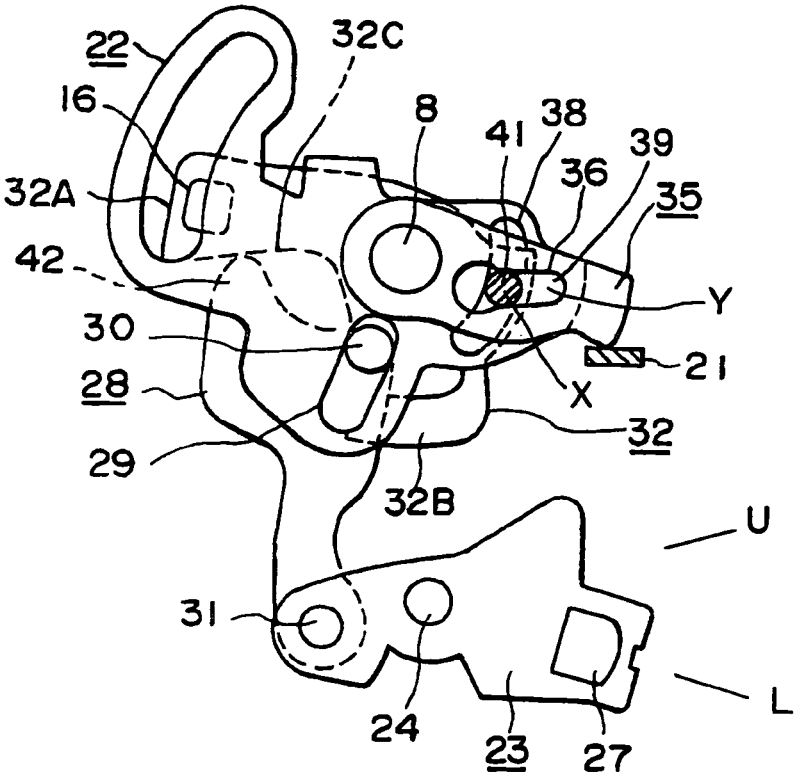
FIG. 11 is an explanatory view showing a state in which the lock lever is at a locked position and the one-motion door opening mechanism is in the effective state.

In FIG. 10, when the lock lever 23 is rotated clockwise toward the locked position L, the lock link 28 moves upward within the slot 29 and, as shown in FIG. 11, the confronting state between the lock pin 30 and the abutting arm 32B is released. In this locked state, even when the open lever 22 is rotated counterclockwise by the outside open handle 25, it is not possible to rotate the ratchet lever 32, and this does not allow the door to be opened.

The lock link 28 comprises a protruding portion 42 extending toward an under surface 32C of the outer arm 32A of the ratchet lever 32. The protruding portion 42 is located in the vicinity of the under surface 32C in the locked state of FIG. 11.

Figure 8:
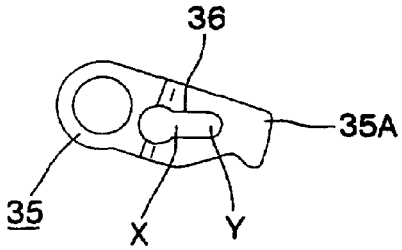
FIG. 8 is a rear view of a sub-lever of the latch unit.

A sub-lever 35 (FIG. 8) is pivotally mounted on the ratchet shaft 8. The sub-lever 35 is located at the rear side of the open lever 22. An inner arm 35A of the sub-lever 35 extending to the interior side is located on a rotating trajectory of the inner lever 21.

Figure 4:
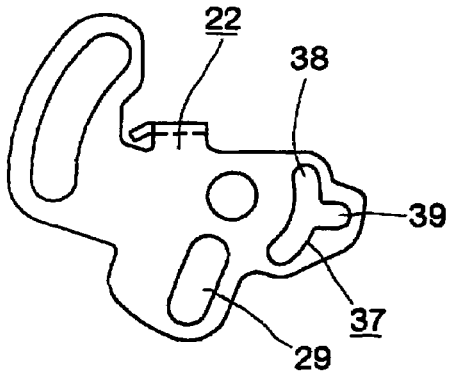
FIG. 4 is a rear view of an open lever of the latch unit.
Figure 5:
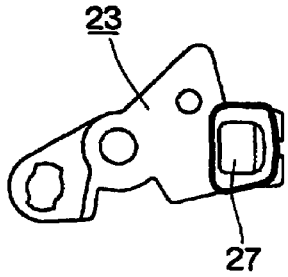
FIG. 5 is a rear view of a lock lever of the latch unit.

The sub-lever 35 is provided with a long hole 36 extending to an almost radial direction of the ratchet shaft 8. The open lever 22 is provided, as shown in FIG. 4, with an engaging groove 37. The engaging groove 37 comprises a circular arc slot 38 with the ratchet shaft 8 as a center and a radial slot 39 extending to the almost radial direction of the ratchet shaft 8 from the central portion of the circular arc slot 38. The ratchet lever 32 has an engaging concave portion 40.

A selector pin 41 extending back and forth is located in the long hole 36 of the sub-lever 35. The selector pin 41 is mounted on the long hole 36 by being slid to the right side after being inserted into the large diameter portion of the left end of the long hole 36. The selector pin 41 is rotated about the ratchet shaft 8 as a center in response to the rotation of the sub-lever 35. The front end of the selector pin 41 penetrates into the engaging groove 37 of the open lever 22 and protrudes in front of the open lever 22. The selector pin 41 switches the one-motion door opening mechanism described below to an effective state and an ineffective state by sliding between an effective position X and an ineffective position Y within the long hole 36.

When the selector pin 41 is in the left side effective position X within the long hole 36, the selector pin 41 is located within the circular arc slot 38 of the open lever 22 and, at the same time, engages with the engaging concave portion 40 of the ratchet lever 32. Hence, the rotational movement of the sub-lever 35 in the effective state is not transmitted to the open lever 22, but is transmitted to the ratchet lever 32 through the selector pin 41. In other words, the selector pin 41 of the effective position X integrally connects the sub-lever 35 and the ratchet lever 32.

FIG. 10 shows a state in which the lock lever 23 is in the unlocked position U and the selector pin 41 is in the effective position X. In this state, when the inner lever 21 is rotated by the door opening operation of the inside open handle 19, the inner lever 21 abuts against the sub-lever 35, and the rotation of the sub-lever 35 is transmitted to the ratchet lever 32 through the selector pin 41, and thereby the ratchet 4 is rotated to be disengaged from the latch 3 through the ratchet pin 16, and this allows the door to be opened.

FIG. 11 shows a state in which the lock lever 23 is in the locked position L and the selector pin 41 is in the effective position X. In this state, when the inner lever 21 is rotated by the door opening operation of the inside open handle 19, the inner lever 21 abuts against the sub-lever 35, and the rotation of the sub-lever 35 is transmitted to the ratchet lever 32 through the selector pin 41. Then, the under surface 32C of the ratchet lever 32 abuts against the protruding portion 42 of the lock link 28 to move the lock link 28 downward and allows the lock lever 23 to return to the unlocked position U from the locked position L. At the same time, the ratchet lever 32 rotates the ratchet 4 through the ratchet pin 16 to release the ratchet 4 from the latch 3, and this allows the door to be opened. In this way, when the selector pin 41 is in the effective position X, even when the lock lever is in the locked state, it is possible to release the locked state and open the door by the door opening operation of the inside open handle 19. This mechanism becomes the one-motion door opening mechanism by the inside open handle 19.

Note that, when the selector pin 41 is in the effective position X, since the selector pin 41 is located within the circular arc slot 38 of the open lever 22, the rotation of the sub-lever 35 is not transmitted to the open lever 22, nor is the rotation of the open lever 22 transmitted to the sub-lever 35.

When the selector pin 41 is slid to the right side ineffective position Y within the long hole 36 of the sub-lever 35, the selector pin 41 is disengaged from the engaging concave portion 40 of the ratchet lever 32 and, at the same time, is displaced to a radial slot 39 from the circular arc slot 38 of the open lever 22. Hence, the rotational movement of the sub-lever 35 in the ineffective state is not transmitted to the ratchet lever 32, but is transmitted to the open lever 22 through the selector pin 41. In other words, the selector pin 41 of the ineffective position Y integrally connects the sub-lever 35 and the open lever 22.

Figure 12:
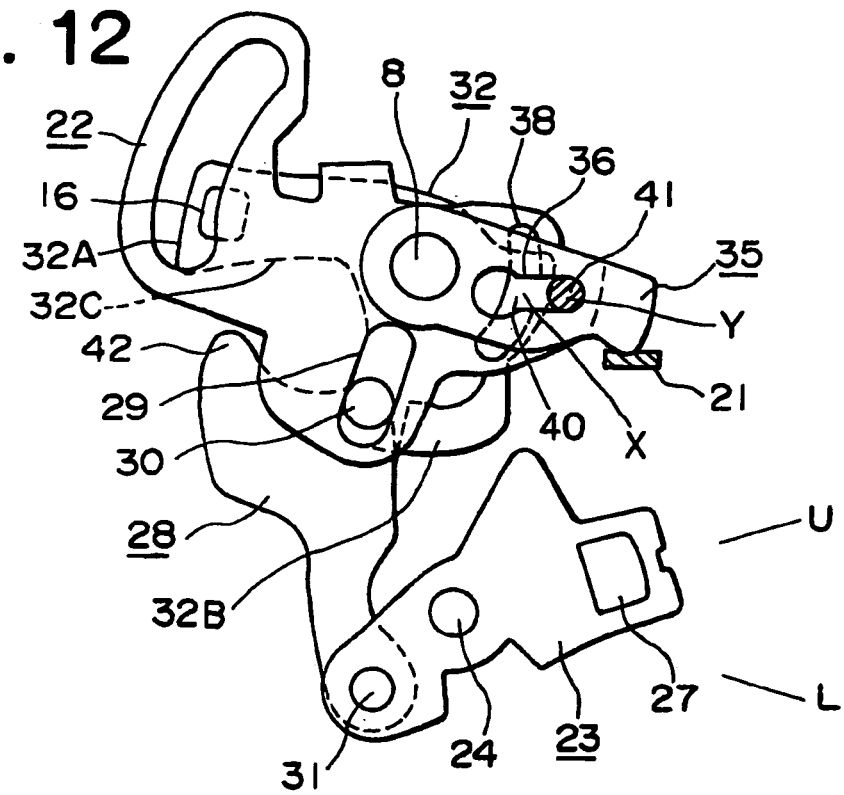
FIG. 12 is an explanatory view showing a state in which the lock lever is in the unlocked position and the one-motion door opening mechanism is in an ineffective state.

FIG. 12 shows a state in which the lock lever 23 is in the unlocked position U and the selector pin 41 is in the ineffective position Y. In this state, when the inner lever 21 is rotated by the door opening operation of the inside open handle 19, the inner lever 21 abuts against the sub-lever 35 to move the selector pin 41 upward. The upward movement of the selector pin 41 of the ineffective position Y does not rotate the ratchet lever 32 directly, but rotates the open lever 22 counterclockwise. When the open lever 22 rotates counterclockwise, the lock pin 30 abuts against the abutting arm 32B to rotate the ratchet lever 32 counterclockwise, and this allows the door to be opened.

Figure 13:
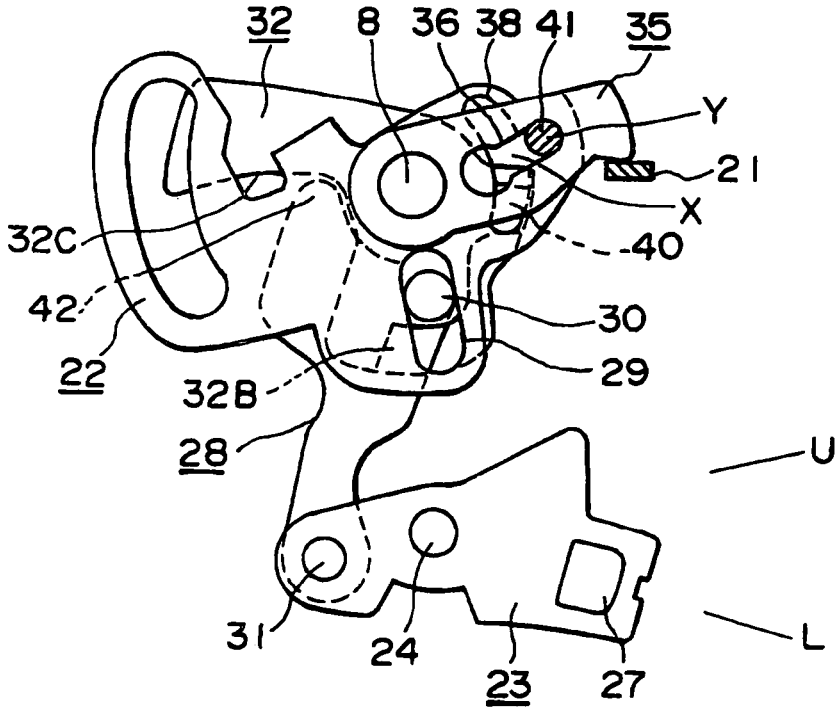
FIG. 13 is an explanatory view showing a state in which the lock lever is in the locked position and the one-motion door opening mechanism is in the ineffective state.

FIG. 13 shows a state in which the lock lever 23 is in the locked position L and the selector pin 41 is in the ineffective position Y. In this state, when the inner lever 21 is rotated by the door opening operation of the inside open handle 19, the inner lever 21 abuts against the sub-lever 35 to move the selector pin 41 upward. The upward movement of the selector pin 41 of the ineffective position Y does not rotate the ratchet lever 32 directly, but rotates the open lever 22 counterclockwise. However, in the locked state, even when the open lever 22 rotates counterclockwise, since the lock pin 30 is unable to abut against the abutting arm 32B, this does not allow the door to be opened. In this way, when the selector pin 41 is in the ineffective position Y, the one-motion door opening mechanism is invalidated.

Figure 9:
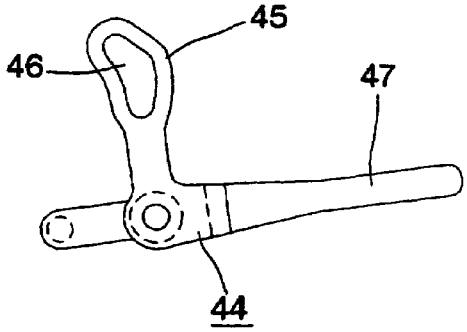
FIG. 9 is a rear view of a switch lever of the latch unit.

As shown in FIG. 2, a sub-plate 43 is mounted on the rear side of the latch unit 1. A switch lever 44 (FIG. 9) is pivotally mounted on the sub-plate 43 by a shaft 48. An upper arm 45 of the switch lever 44 is provided with an engaging window 46 with which the rear end portion of the selector pin 41 is engaged. The tip end of an operation arm 47 of the switch lever 44 is extended to the interior side to penetrate into a metal panel of the door, and is protruded outside of the door. The switch lever 44 is rotated by the operation of the operation arm 47 and the switch lever 44 displaces the selector pin 41 between the effective position X and the ineffective position Y.

Figure 14:
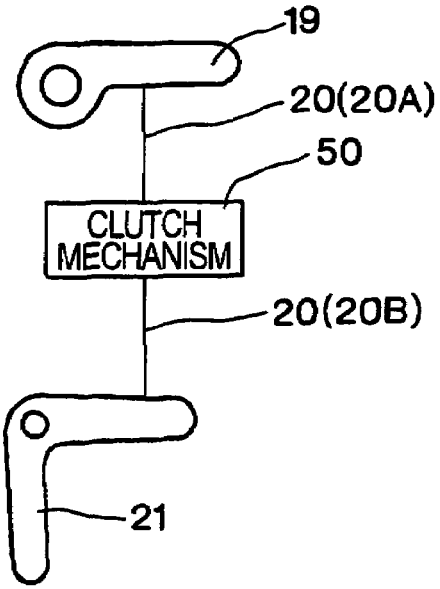
FIG. 14 is a schematic view showing a relation among an inside open handle, an inner lever and a clutch mechanism.
Figure 15:
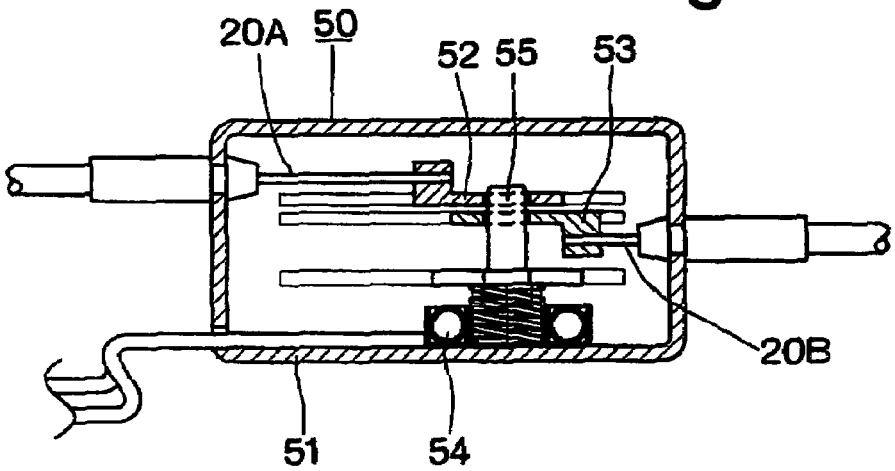
FIG. 15 is a sectional view showing a mechanical mechanism of the clutch mechanism.
Figure 16:
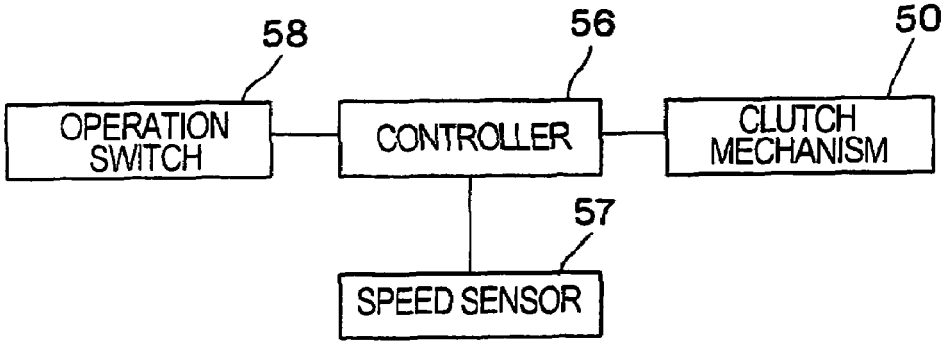
FIG. 16 is a block circuit diagram of the clutch mechanism.

Between the inner lever 21 and the inside open handle 19, as shown in FIG. 14, there is provided a clutch mechanism 50. The mechanical portion of the clutch mechanism 50 is housed inside a case 51. The case 51 is formed small so as to be housed within the door. Within the case 51, an input side lever 52 and an output side lever 53 are slidably housed. The input side lever 52 is connected to the inside open handle 19 by an input side wire 20A of the wire 20, and the output side lever 53 is connected to the inner lever 21 by an output side wire 20B of the wire 20. Within the case 51, a clutch pin 55 driven by an actuator 54 such as an electromagnetic coil and the like is provided. The clutch pin 55 connects the input side lever 52 and the output side lever 53 when the actuator 54 is turned on, and disconnects the input side lever 52 and the output side lever 53 when the actuator 54 is turned off.

The actuator 54 is turned on and off by a command from a controller 56. The controller 56 turns off the actuator 54 to release a connection between the inside open handle 19 and the inner lever 21 when a speed sensor 57 detects a running state of a vehicle (practically a running state at the speed of more than 4 Km/h). When the connection between the inside open handle 19 and the inner lever 21 is released by running, since the inner lever 21 is not rotated even when the inside open handle 19 is operated to open the door, the door is prevented from opening even though the one-motion door opening mechanism is added to the latch unit 1. Hence, even when the inside open handle 19 is falsely operated while running, the one-motion door open mechanism is not actuated.

When the vehicle stops (actually a stopping state or a running state at the speed below 4 Km/h), the controller 56 turns on the actuator 54 to connect the inside open handle 19 and the inner lever 21. This allows the one-motion door opening mechanism of the latch unit 1 to be actuated by the door opening operation of the inside open handle 19 while parking.

In the control circuit of the clutch mechanism 50, it is possible to provide a manual operation switch 58 which turns off the actuator 54. The operation switch 58 is preferably disposed in the vicinity of a driver's seat. When the operation switch 58 is turned on, the clutch mechanisms 50 is put into a non-connecting state even while parking, and the door opening operation of the inside open handle 19 is invalidated. This means that a child proof mechanism is added to the latch unit 1 by the operation switch 58.

Since the clutch mechanism 50 can release the connection between the inside open handle 19 and the inner lever 21, it is expected that the mechanism 50 can bring about improvements of the security performance of the door. Hence, in the present invention, when the engine of the vehicle is stopped or a key is not inserted into an ignition switch, the actuator 54 is turned off to disconnect the inside open handle 19 and the inner lever 21. This allows the door opening operation of the inside open handle 19 to be invalidated, thereby improving the security performance while parking.

Effects of the Invention

The one-motion door opening mechanism according to the present invention can be switched over to the effective state and the ineffective state. Hence, the one-motion door opening mechanism can be adapted to the door latch device of all the doors, and if safety is ensured at the user's responsibility, almost all people can enjoy the convenience of the one-motion door opening mechanism.

Since the clutch mechanism 50 can be provided between the inside open handle 19 and the inner lever 21, the one-motion door opening mechanism of the door latch device already mounted on the door can be simply switched over to a speed sensing type at a later time.

The invention claimed is:

1. A one-motion door opening mechanism for a vehicle door latch device comprising:

a ratchet lever for opening a vehicle door when rotated;

an open lever being displaced by a door opening rotation of an outside open handle of the door;

a lock lever displaceable between an unlocked position in which a displacement of the open lever is transmitted to the ratchet lever so as to rotate the ratchet lever and an locked position in which the displacement of the open lever is not transmitted to the ratchet lever;

a sub-lever being rotated by a door opening rotation of an inside open handle of the door; and a selector pin displaceable between an effective position and a ineffective position;

wherein said ratchet lever is constituted so as to be able to return the lock lever located in the locked position to the unlocked position when rotated;

wherein said selector pin, when located in the effective position, rotates the ratchet lever by a rotation of the sub-lever so that both of a returning of the lock lever to the unlocked position from the locked position and an opening of the vehicle door are made possible;

wherein when said selector pin is switched to the ineffective position, the selector pin transmits the rotation of the sub-lever to the ratchet lever only through the open lever.

2. The one-motion door opening mechanism for the vehicle door latch device according to claim 1, wherein the ratchet lever, the open lever and the sub-lever are coaxially pivoted by a single common shaft.

3. The one-motion door opening mechanism for the vehicle door latch device according to claim 2, wherein said sub-lever comprises a long hole extending to a radial direction of the common shaft, and said selector pin is switched over to the effective position and the ineffective position by sliding within the long hole.

4. The one-motion door opening mechanism for the vehicle door latch device according to claim 3, wherein said ratchet lever comprises an engaging concave portion which does not engage with the selector pin in the ineffective position, but engages with the selector pin in the effective position.

5. The one-motion door opening mechanism for the vehicle door latch device according to claim 3, wherein said open lever comprises the engaging groove which does not engage with the selector pin in the effective position, but engages with the selector pin in the ineffective position.

6. The one-motion door opening mechanism for the vehicle door latch device according to claim 1, wherein a clutch mechanism which can releases a connection between the inside open handle and the sub-lever is provided between the inside open handle and the sub-lever.

7. The one-motion door opening mechanism for the vehicle door latch device according to claim 6, wherein, when the vehicle drives, the clutch mechanism release the connection between the inside open handle and the sub-lever.

* * * * *